United States Patent [19]

Lehmann

[11] 4,343,436

[45] Aug. 10, 1982

[54] METHOD AND APPARATUS FOR THE SPRAY-COATING OF THE INSIDE OF TUBULAR BODIES HAVING A SEAM

[75] Inventor: Ernst Lehmann, St. Gallen, Switzerland

[73] Assignee: Gema AG Apparatebau, Switzerland

[21] Appl. No.: 137,395

[22] Filed: Apr. 4, 1980

[30] Foreign Application Priority Data

Apr. 12, 1979 [DE] Fed. Rep. of Germany ..... 2914960

[51] Int. Cl.[3] ..... B05C 7/02

[52] U.S. Cl. ..... 239/696; 118/308; 118/622; 118/DIG. 10; 134/166 C; 239/698; 239/143; 239/290; 239/405; 239/436; 239/499; 239/551; 239/565; 366/101; 427/28; 427/181; 427/239; 427/286

[58] Field of Search ..... 118/306, 308, 317, 622, 118/DIG. 10; 427/28, 181, 239, 286; 134/166 C, 167 C, 168 C, 169 C, 22 C; 366/101; 239/143, 290, 301, 405, 430, 499, 500, 536, 565, 690, 696, 698, 705–707, 551, 444

[56] References Cited

U.S. PATENT DOCUMENTS

| | | | |
|---|---|---|---|
| 3,081,947 | 3/1963 | Walter . | |
| 3,248,606 | 4/1966 | Faser . | |
| 3,422,795 | 1/1969 | Smith | 118/317 X |
| 3,678,336 | 7/1972 | Winkless | 118/622 |
| 3,871,583 | 3/1975 | Kellert | 366/101 X |
| 4,088,268 | 5/1978 | Vohringer | 239/143 X |
| 4,171,096 | 10/1979 | Welsh et al. | 239/301 X |

FOREIGN PATENT DOCUMENTS

| | | | |
|---|---|---|---|
| 733740 | 4/1943 | Fed. Rep. of Germany . | |
| 22858 | 3/1962 | Fed. Rep. of Germany | 239/499 |
| 7636666 | 3/1977 | Fed. Rep. of Germany . | |

OTHER PUBLICATIONS

German Publication 21 27 406, Feb. 3, 1972.

*Primary Examiner*—Andres Kashnikow

*Attorney, Agent, or Firm*—Ostrolenk, Faber, Gerb & Soffen

[57] ABSTRACT

A method and apparatus are disclosed for the spray-coating of the interior of a hollow body, one region of which, e.g. a seam, must receive a heavier coating than the remainder of the surface to be sprayed. A single spray coating operation is performed, in which a relatively heavy spray jet is concentrated on the seam and a relatively thin cloud of coating material is used to coat the entire interior surface of the body. Preferably, a cloud of electrostatically charged coating material is formed by an atomizer fed by a feed conduit from which a certain amount of coating material is diverted to be formed into the relatively highly concentrated spray jet directed at the seam. The relatively high-velocity particles of material of the spray jet which is concentrated onto the seam and the relatively low-velocity particles of material of the coating cloud together produce on the seam a thinner layer of material than would normally suffice and which, nonetheless, adheres well.

26 Claims, 5 Drawing Figures

METHOD AND APPARATUS FOR THE SPRAY-COATING OF THE INSIDE OF TUBULAR BODIES HAVING A SEAM

BACKGROUND OF THE INVENTION

The present invention relates to a method and apparatus for spray coating the inside of a tubular body having a seam, and particularly a can body. It relates particularly and preferably to a method and apparatus for electrostatically spraying a pulverulent or other powdered coating material by means of a spray jet directed at the seam of the body to be spray-coated.

As long as cans have been used as containers for beverages and foodstuffs, they have been made from so-called tinplate, i.e. steel plate covered with a thin layer of tin. Since it has been realized that direct contact between the food and the tin is undesirable, the inside of tinplate cans is normally sprayed with a thin lacquer. Today so-called three-part cans are predominantly used for foods and beverages. A three-part can consists of a body, constituting the usually cylindrical side walls of the can, a bottom and a top. The can bodies are made from rolled metal plate. After a rectangular piece of plate that is to be made into a can body is rolled, the pair of now adjacent opposite edges are connected by a double-seam or a special welding. The seam or welding requires a thicker coating than the rest of the can body. The reasons for this have been described in detail in German Utility Model 76 36 666. The top and bottom of the can are then joined to the can body.

Two approaches have been used in the past to solve the related problems of coating an article which has different bonding strengths for the coating material at different places, and of coating an article with different thicknesses of coating material placed at different places. Either the areas that must be differently coated are coated in separate operations, or else the entire surface of the article must be coated with a uniform thickness at least as great as the maximum thickness of coating required anywhere on the surface of the article. The former method, which involves a separate coating operation for each area that must be coated to a different thickness, employs very expensive spraying apparatus and requires a great amount of time, due to the multiple spraying operations. The latter method is faster and can be done with less expensive equipment but requires a large amount of coating material. In order to minimize total costs, the second approach has been preferred in the past, despite the consumption of excess coating material. Since, however, the coating material is also expensive, it has been proposed in German Utility Model 76 36 666, mentioned above, to coat the seams of the can body seams by means of a guide body which concentrates the coating material onto the seams. The remaining portion of the interior of the can is sprayed before or after the seams are sprayed. Thus two operations are employed in order to save coating material.

U.S. Pat. No. 3,081,947 discloses a device for spray coating the interior of a can with a liquid. According to this known method, the spraying apparatus and the can body must be turned relative to each other during the spraying in order to coat all regions of the interior of the can. This procedure requires that the coating material be fed to the spraying apparatus discontinuously. The apparatus used is expensive and prone to breakdowns.

SUMMARY OF THE INVENTION

The object of the present invention is to provide a method and apparatus that solve the problem of coating articles which must be sprayed at different points with different thicknesses of coating material .

It is a further object to do so with a relatively short spraying time for each article sprayed, by using a relatively inexpensive apparatus and using less coating material for each article.

These objects are achieved in accordance with the method of the invention by simultaneously producing both a spray jet, which is substantially directed at the seam of the tubular can body, and a cloud of coating material, which covers an entire longitudinal section of the interior wall of the can body.

The apparatus of the invention has a spray-material feed line. One outlet from the feed line is provided for the production of a relatively concentrated spray jet for coating substantially only the seam, and a second outlet is provided to produce a relatively diffuse cloud of coating material to coat the remainder of the interior surface of the article to be sprayed.

The basic concept of the invention, therefore, is that when different regions of an article are to be treated differently, two streams of coating material are used simultaneously. One jet is directed substantially in a single direction while the other produces a broad cloud of coating material that covers the entire surface to be spray coated. This means that different regions of the surface of an article which are to be treated differently can be spray coated simultaneously in a single spraying operation. Moreover, each region of such an article is provided with a layer having only the minimum thickness that is acceptable for that region. This results in a saving in time of about 50% and in a substantial saving of coating material. No relative rotation of the article and the spraying apparatus is necessary according to the invention.

At present, the requirements that must be satisfied by a coating on a can are stricter than ever. These increased requirements are satisfied by coating the interior of the can with a plastic powder and then fusing and curing the plastic layer. The present invention is particularly subitable for such powder coating.

The coating material of the main cloud and/or of the additional jet spray can also be electrostatically charged as it is sprayed. The electrical charging of coating material is known from Swiss Patent 509,106.

Other objects and features of this invention will become apparent from the following description of the accompanying drawings.

DETAILED DESCRIPTION OF THE INVENTION

In what follows, "powder" is to be understood to means a pulverulent to granular material.

The preferred field of use of the invention is the coating of the inside of cans with a plastic powder. The invention will accordingly be described with respect to this application. However, the invention is not limited to this application.

Figure 1:
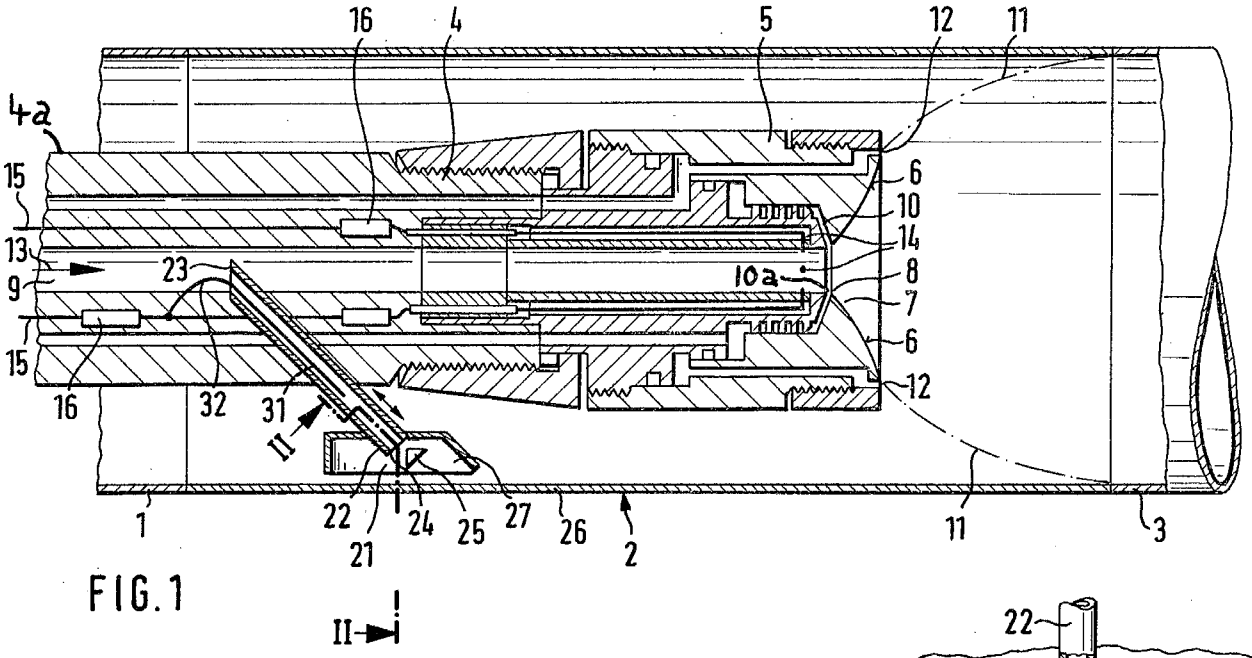
FIG. 1 is a diagrammatic fragmentary axial section through a powder spray apparatus in accordance with the invention.
Figure 2:
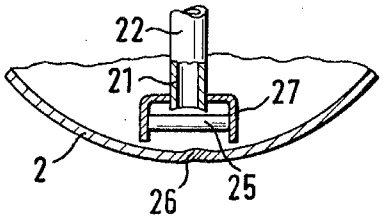
FIG. 2 is a diagrammatic view of a portion along the plane II—II of FIG. 1.

In FIG. 1, tubular can bodies 1, 2 and 3 are delivered in a row, arranged coaxially, from a double seaming or welding machine, not shown. Each can body 1–3 has a respective seam or weld 26. The can bodies 1–3 are delivered to the spray device 4 with their respective seams 26 aligned end to end, so that the seam 26 of each can body 1–3 can be properly sprayed in the manner described below.

A spray device 4 in accordance with the invention is preferably flanged permanently onto the double-seaming or welding machine. The can bodies 1–3 are fed along the length of the spray device 4 in a row that is generally co-axial with the spray device 4.

The spray device 4 shown in FIG. 1 includes an atomizer head 5 which fits over the downstream end of tube 4*a*. The tube 4*a* is flanged onto the double-seaming or welding machine, as stated above. The atomizer head 5 provides a uniform coating of plastic powder or other material over the entire interior surface of the can body. The coating material is supplied via a feed conduit 9 in the direction indicated by the arrow 13. The feed conduit 9 terminates at its downstream end at the upstream end 8 of a mouth opening 7. The mouth opening 7 progressively widens, so that it has a flared surface 6. A helical gas channel 10 terminates at the upstream end 8 of the mouth opening 7 in an orifice 10*a* that has the shape of an annular slot. A gas is fed through the gas channel 10. The helical shape of the gas channel 10 imparts a twisting or rotational motion to the gas. The rotating gas emerging from the annular orifice 10*a* of the gas channel 10 eddies and atomizes the coating material powder passing from the feed conduit 9 through the mouth opening 7. The shape of the resulting cloud 11 of atomized material can be controlled by a blanket or envelope of gas which emerges from a second annular nozzle 12 which is located surrounding the downstream end of the flared mouth opening 7.

Electrodes 14 are provided extending into the feed conduit 9 near its downstream end for the purpose of electro-statically charging the powdered coating material. Electric power is supplied to the electrodes 14 via the feed wires 15, which include resistors 16. The electrodes 14 are preferably at a DC voltage of between 64 kV and 70 kV.

A supplementary spray device 21 is provided for spray-coating the seam 26 of each can body 1–3. The supplementary spray device 21 includes a tube 22 disposed in one wall of tube 4*a*. The inlet end 23 of tube 22 extends into the feed conduit 9 upstream of the atomizer head 5. The tube 22 is arranged at an acute angle to the feed direction of coating material along the feed conduit 9 and to the feed conduit 9, and the inlet end 23 is cut off perpendicular to the feed conduit 9. As a result, part of the coating material is diverted from the feed conduit 9 into the tube 22. A baffle 25 is provided near the other end 24 of the tube 22. Coating material which has been diverted through tube 22 strikes the baffle 25 and is atomized. A hood 27 surrounds the downstream end 24 of the tube 22 and the baffle 25 for directing the supplementary atomizer jet in concentrated or focused form against the seam 26. The hood 27 concentrates the supplementary spray jet onto the seam 26 of the can body 2 which is to be coated. The atomized material passes in the form of a concentrated spray jet against the seam 26 of the can body 2.

The stream of coating material that is diverted through tube 22 is electrostatically charged by means of an electrode 31, which is a thin wire inserted in the tube 22. The electrode 31 is electrically connected via a connecting wire 32 with the wire 15 to which electrodes 14 are connected and which is at a DC voltage of, for example, 64 kV.

Figure 1A:
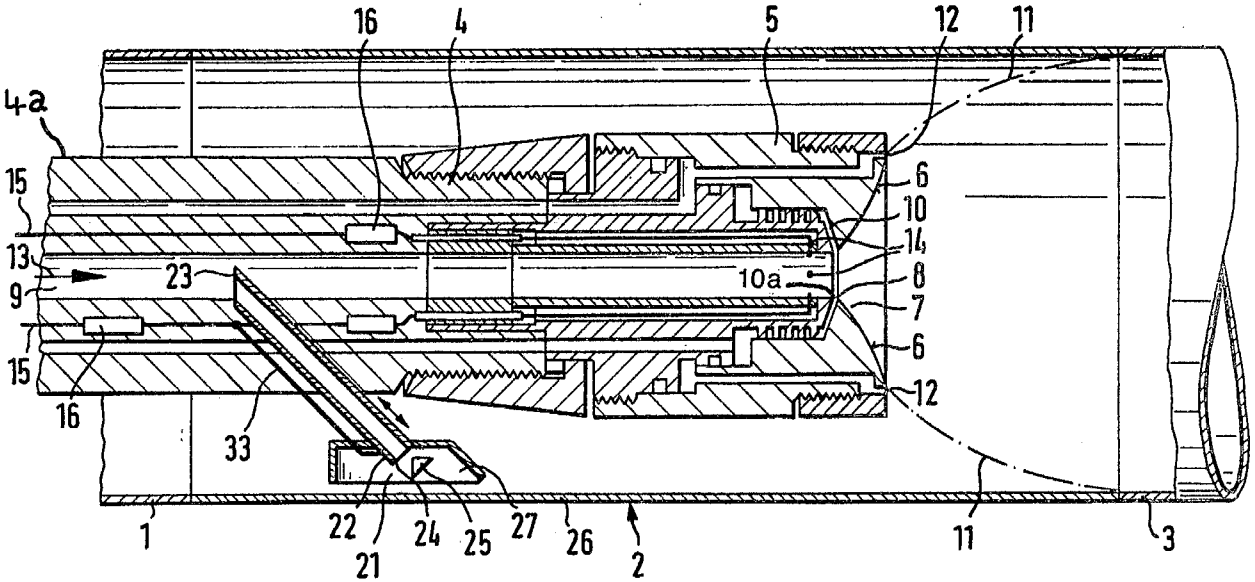
FIG. 1A is a view like that of FIG. 1 showing another preferred embodiment of the invention.

In an alternative embodiment, shown in FIG. 1A, an electrode 33 which is disposed along the length of the exterior of tube 22 is substituted for the electrode 31 a connecting wire 32 shown in FIG. 1. The external electrode 33 extends into the hood or mask 27.

Figure 3:
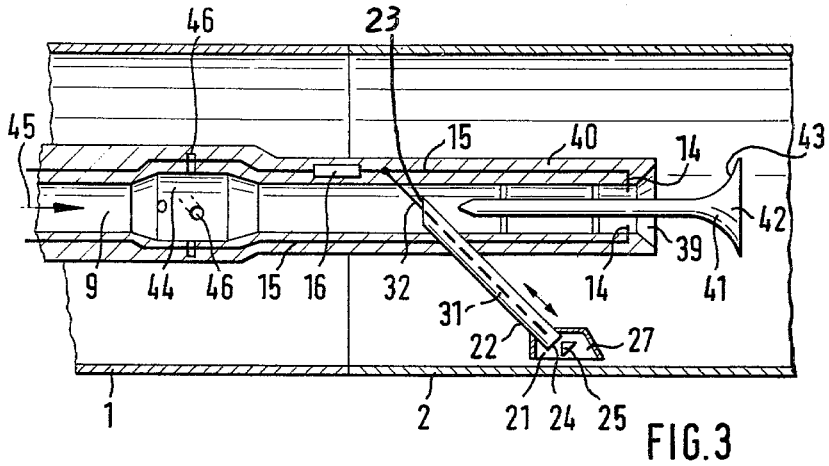
FIG. 3 is a fragmentary axial section of another embodiment for spraying powder in accordance with the invention.

Another preferred embodiment of the invention is illustrated in FIG. 3. FIG. 3 shows a spray device 40 having an atomizer 41 of the type known from Swiss Pat. No. 429,517. The main stream of coating material which is fed via the feed conduit 9 is atomized by a baffle member 42 disposed in the mouth opening 39 of the spray device 40. The baffle member 42 has a baffle plate 43 transverse to the direction of flow in the feed conduit 9. The coating material supplied to the mouth opening 39 via feed conduit 9 is deflected and thereby atomized by the baffle plate 43.

Because the coating material is atomized by the baffle member 42, the spray device 40 does not need the progressively and continuously widening mouth 7 of the embodiment of FIG. 1. The mouth 39 of the feed conduit 9 of the embodiment shown in FIG. 3 is accordingly only slightly beveled outward.

The tube 22 of the supplemental spray device 21 in FIG. 3 is displaceable along its axis so that its inlet end 23 extends to an adjustable extent into the common conduit 9. As a result, it is possible to adjust the amount of material diverted from the common conduit 9 into the supplemental spray device 21 per unit of time.

The coating material tends to vary in its concentration and to become non-homogeneous in the conduit 9. To correct this problem, a generally cylindrical twist chamber or eddy chamber 44 is located in the common conduit 9 upstream of and close to the inlet end 21 of the branching tube 22, as shown in FIG. 3. The eddy chamber 44 is arranged coaxial with the common conduit 9. Gas channels or gas nozzles 46 provided in the wall of spray device 40 discharge into the eddy chamber 44 generally transversely to the direction of flow 45 of the coating material in the common feed conduit 9, in such a manner that the coating material flowing through the feed conduit 9 is caused to eddy in the eddy chamber 44. For this purpose, the gas nozzles 46 are aimed into the eddy chamber 44 substantially circumferentially or tangentially. The coating material is divided up homogeneously by the transverse gas jets in the eddy chamber 44.

Figure 4:
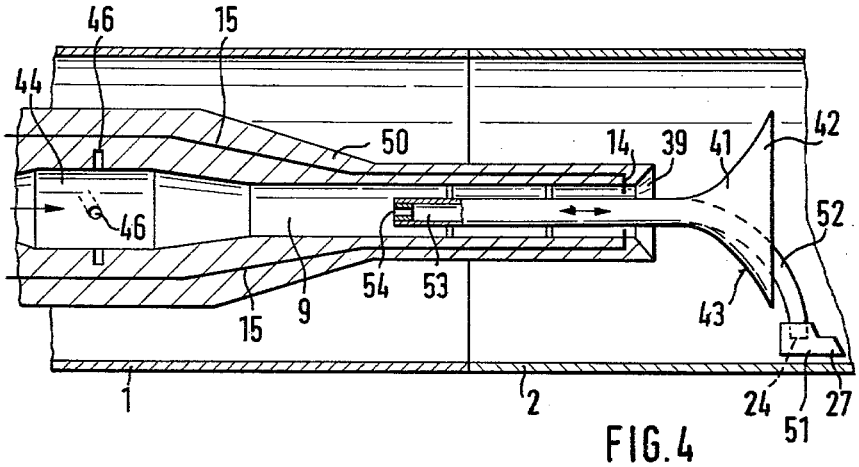
FIG. 4 is a fragmentary axial section of still another embodiment for spraying powder in accordance with the invention.

FIG. 4 shows another embodiment 50 of the spray device of the invention. A supplementary spray device 51 for the delivery of a concentrated atomizer jet aimed at a given point is provided. Unlike the previously described embodiments, the supplementary spray device 51 comprises a curved branch line 52 in place of a straight tube. The spray jet it produces is directed toward the interior of the wall of can body 2. The inlet end 53 of the branch line 52 is located at the upstream end of the baffle member 42, through which the branch line 52 extends. The outlet end 24 of the branch line 52 is located away from the center of the feed conduit 9 and near the portion of the wall of the can body 2 at which it is aimed. A replaceable flow throttle valve 54 is disposed in the inlet section 53 of the branch line 52. By means of the flow throttle valve 54, the amount of coating material diverted into the branch line 52 can be adjusted.

Many variations of the foregoing embodiments of the invention are possible. For instance, it is possible to atomize the supplementary stream of material in the same manner as the main stream. It is only necessary that the supplemental atomizer spray jet be relatively highly focused so as to coat only a single region of the article being coated. A focused jet can be obtained by use of an appropriate means for atomization or of a hood, masks or jet pipe. The coating material could be homogenized in the feed conduit 9 by a twist chamber whose cross section is the same as that of the feed conduit 9 and into which gas channels or gas nozzles 46 discharge in a direction generally transverse to and generally tangential to the circumference of the preferably circular cross-section of the feed conduit 9.

In another embodiment of the invention, the can bodies 1, 2 and 3 are delivered on a known so-called transfer device and held in place while the spray device 4 is passed into each can body in turn to coat it.

Although the present invention can be described in connection with preferred embodiments thereof, many variations and modifications will now become apparent to those skilled in the art. It is preferred, therefore, that the present invention be limited not by the specific disclosure herein, but only by the appended claims.

What is claimed is:

1. An apparatus for spray coating the interior of a hollow body, comprising:

first atomizer means for atomizing a coating material for producing a cloud of the coating material inside the interior of the hollow body for coating the body interior with the coating material;

feed conduit means for transporting the coating material to the first atomizer means for atomization;

spray jet atomizer means for aiming a spray of coating material at a selected region of the interior of the hollow body for spray coating the selected region with a layer of the coating material; and means for feeding coating material to the spray jet atomizer means simultaneously with the transportation of coating material to the first atomizer means, whereby the first atomizer means and the spray jet atomizer means can respectively atomize the spray simultaneously;

and additional means for adjusting the relative volumes of flow of coating material to the first atomizer means and to the spray jet atomizer means;

said first atomizer means producing a cloud of the coating material inside the interior of a hollow body for uniformly coating the body interior with the coating material.

2. The apparatus of claim 1, wherein the first atomizer means further comprises means for electrostatically charging the coating material flowing through the first atomizer means.

3. The apparatus of either of claim 1 or 2, wherein the spray jet atomizer means further comprises means for electro-statically charging the coating material that passes through the spray jet atomizer means.

4. The apparatus of claim 3, wherein the charging means further comprises electrode means.

5. The apparatus of claim 1, further comprising a common conduit for transporting the coating material, wherein the feed conduit means and the means for feeding both receive coating material from the common conduit.

6. The apparatus of claim 5, wherein the means for feeding coating material comprises a tube which has an inlet end that extends into the common conduit and opens to face upstream in the common conduit, for diverting from the common conduit a portion of the coating material being transported therein.

7. The apparatus of claim 6, wherein the feed conduit means is continuous with the common conduit.

8. The apparatus of claim 6, wherein the tube is oriented obliquely relative to the common conduit, whereby the direction of flow in the tube forms an acute angle with the direction of flow in the common conduit.

9. The apparatus of claim 8, wherein the inlet end of the tube is oriented obliquely to the rest of the tube and generally transverse to the common conduit.

10. The apparatus of claim 6, further comprising means for adjusting the radial depth to which the inlet end of the tube extends into the common conduit.

11. The apparatus of either of claim 6 or 8, further comprising means for adjusting the relative volumes of flow through the tube and the feed conduit means.

12. The apparatus of claim 11, wherein the adjusting means comprises flow throttle valve means located at the inlet end of the tube.

13. The apparatus of claim 6, further comprising eddy chamber means located in the common conduit, the eddy chamber means being for agitating the coating material, thereby to homogenize it.

14. The apparatus of claim 13, wherein the eddy chamber means is located near and upstream of the inlet end of the tube.

15. The apparatus of claim 13, wherein the eddy chamber means comprises means for injecting gas into the common conduit to agitate the coating material therein.

16. The apparatus of claim 15, wherein the gas injection means comprises gas nozzles oriented to inject gas into the common conduit in a direction that is generally transverse to the direction of flow of coating material therein.

17. The apparatus of claim 16, wherein the gas nozzles are further oriented to inject gas in a direction to impart to the coating material flowing in the common conduit a rotary component of motion about an axis parallel to the direction of extension of the common conduit.

18. The apparatus of any of claims 13, 14, or 15 wherein the eddy chamber means is defined by a widening of the common conduit.

19. The apparatus of any of claims 1, 5, 6, or 15, wherein the first atomizer means comprises a progressively widening mouth opening at the downstream end of the feed conduit means.

20. The apparatus of claim 19, wherein the first atomizer means further comprises means for expelling gas from an orifice adjacent the mouth opening to provide a gas envelope to shape a cloud of atomized coating material formed at the mouth opening by the atomizer means.

21. The apparatus of claim 20, wherein the orifice of the gas envelope forming means is annular and surrounds the mouth opening.

22. The apparatus of any of claims 1, 5, 6, or 15, wherein the first atomizer means includes a mouth opening at the downstream end of the feed conduit means and a baffle member disposed in the mouth opening for atomizing coating material.

23. The apparatus of claim 22, wherein the means for feeding coating material to the spray jet atomizer means is located at least partially in the baffle member.

24. The apparatus of claim 23, wherein the first atomizer means further comprises electrode means located upstream of and near the mouth opening, the electrode means being for electrostatically charging the coating material flowing through the atomizer means.

25. The apparatus of claim 17, wherein the tube of the means for feeding coating material has an outlet end, and wherein the spray jet atomizer means further comprises hood means disposed at the outlet end of the tube for concentrating a jet spray of coating material produced by the spray jet atomizer means.

26. The apparatus of claim 25, wherein the spray jet atomizer means further comprises baffle means disposed at the outlet end of the tube for concentrating and directing the jet spray of coating material produced by the spray jet atomizer means.

* * * * *